US005675981A

United States Patent [19]

Lee

[11] Patent Number: 5,675,981

[45] Date of Patent: Oct. 14, 1997

[54] COOL AIR REGULATOR STRUCTURE OF A REFRIGERATOR

[75] Inventor: Sang-Moo Lee, Incheon, Rep. of Korea

[73] Assignee: Daewoo Electronics Co., Ltd., Seoul, Rep. of Korea

[21] Appl. No.: 719,883

[22] Filed: Sep. 25, 1996

[30] Foreign Application Priority Data

Sep. 26, 1995 [KR] Rep. of Korea ..... 95-26112

[51] Int. Cl.[6] ..... F25D 17/08

[52] U.S. Cl. ..... 62/187; 62/408

[58] Field of Search ..... 62/187, 408; 236/49.3

[56] References Cited

U.S. PATENT DOCUMENTS

| | | | |
|---|---|---|---|
| 2,768,510 | 10/1956 | McCloy | 62/408 |
| 3,248,894 | 5/1966 | Harbour | 62/187 |
| 4,122,687 | 10/1978 | McKee | 62/187 |
| 4,296,611 | 10/1981 | Griffin et al. | 62/408 |
| 4,642,998 | 2/1987 | Kang et al. | 62/187 |
| 5,375,428 | 12/1994 | LeClear et al. | 62/187 |
| 5,460,009 | 10/1995 | Wills et al. | 62/187 |
| 5,555,736 | 9/1996 | Wills et al. | 62/187 |
| 5,611,212 | 3/1997 | Graviss et al. | 62/187 |

*Primary Examiner*—William E. Tapolcai

*Attorney, Agent, or Firm*—Beveridge, DeGrandi, Weilacher & Young LLP

[57] ABSTRACT

A cool air regulator structure of a refrigerator regulates the quantity of cool air supplied into a freezing compartment and a fresh food compartment by driving a driving part. Cool air return ducts are formed within a separating plate between the freezing compartment and fresh food compartment, and an air variable blade swinging by the driving part is provided to the rear side of the cool air return ducts. When a temperature of the freezing compartment is higher than a preset temperature and a temperature of the fresh food compartment reaches a preset temperature, temperature sensors sense the current temperature status to drive the driving part, thereby swinging the air variable blade downward. The quantity of cool air is adjusted by the swinging of the air variable blade upward in the contrary manner; otherwise, the air variable blade maintains the neutral position thereof.

6 Claims, 2 Drawing Sheets

COOL AIR REGULATOR STRUCTURE OF A REFRIGERATOR

BACKGROUND OF THE INVENTION

1. Field of the Invention

The present invention relates to a refrigerator, and more particularly to a cool air regulator structure of a refrigerator capable of regulating the quantity of cool air supplied into a freezing compartment and a fresh food compartment by means of an air variable blade.

2. Description of the Prior Art

FIG. 1 illustrates a side sectional view of a refrigerator according to a conventional art. A general household refrigerator 1 as shown in FIG. 1 supplies cool air in a low temperature state generated from an evaporaror 40 to a freezing compartment 10 or fresh food compartment 20 by the rotation of a fan 14. In order for the cool air to flow, a cool air flow passage is provided from a main cool air duct 50 installed with evaporator 40 therein, which is then communicated with freezing compartment 10 and fresh food compartment 20. An erected isolating plate 11 is installed to the front side of fan 14, and a plurality of cool air supply holes 12 for suppling the cool air are perforated through isolating plate 11. A separating plate 30 is placed between freezing compartment 10 and fresh food compartment 20. A cool air return duct 31 is formed within separating plate 30. A partition 32 of a single plate is installed within cool air return duct 31 to horizontally define upper and lower cool air return ducts 31 and 31. A refrigerating duct 60 is formed in a rear wall 13 at the rear side of a motor. Refrigerating duct 60 is connected to an upper end of fresh food compartment 20. An isolating plate 61 is installed to the front of rear wall 13. A plurality of cool air supply holes 62 are formed in isolating plate 61. A plurality of shelves 63 are furnished into fresh food compartment 20. Respective doors 80 and 80 are installed to the front of freezing compartment 10 and fresh food compartment 20.

In regard to an operation of refrigerator 1 according to the conventional art, the cool air from evaporator 40 installed to the rear side of rear wall 13 of freezing compartment 10 is admitted into freezing compartment 10 via cool air supply holes 12 in isolating plate 11. The cool air supplied into freezing compartment 10 returns to main cool air duct 50 via upper cool air return duct 31 formed within separating plate 30 installed to the bottom of freezing compartment 10. The supply of the cool air into fresh food compartment 20 is performed in such a manner that the cool air passes through refrigerating duct 60 formed within rear wall 13 of refrigerator 1 to be provided to the interior of fresh food compartment 20 via cool air supply holes 62 in isolating plate 61. The cool air supplied into fresh food compartment 20 returns to the interior of main cool air duct 50 via lower cool air return duct 31 formed within separating plate 30.

However, the cool air return duct of the refrigerator according to the conventional art described as above has no structure for regulating the quantity of the cool air returning from freezing compartment 10 and fresh food compartment 20. Therefore, there is a drawback that the cool air is overly supplied to freezing compartment 10 or fresh food compartment 20 which causes food to degenerate.

SUMMARY OF THE INVENTION

Therefore, it is an object of the present invention to provide a cool air regulator structure of a refrigerator, wherein the quantity of cool air returning from a freezing compartment or fresh food compartment is regulated by an air variable blade for maintaining a proper temperature throughout the freezing compartment and fresh food compartment to prevent the degeneration of food refrigerated therein.

To achieve the above object of the present invention, there is provided a cool air regulator structure of a refrigerator, wherein a cool air return duct formed within a separating plate installed between a freezing compartment and a fresh food compartment is partitioned into upper and lower cool air return ducts by means of two plates, and an air variable blade swinging by a driving part is furnished thereto.

Preferably, a solenoid coil capable of fully closing/opening the air variable blade is utilized as the driving part.

More preferably, a step motor capable of opening/closing the air variable blade in stages may be employed as the driving part.

It should be noted that a cooling fan is installed to the immediate rear side of the cool air return ducts for facilitating the circulation of the cool air, and evaporators are installed to the up and down portions of the cooling fan.

In the refrigerator having the cool air regulator structure according to the present invention constructed as above, the quantity of cool air supplied into the freezing compartment and fresh food compartment can be regulated to maintain the proper temperature throughout the freezing compartment and fresh food compartment, thereby preventing degeneration of the food refrigerated therein.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENT

A cool air regulator structure according to the present invention will now be described in detail with reference to FIG. 2.

Figure 1:
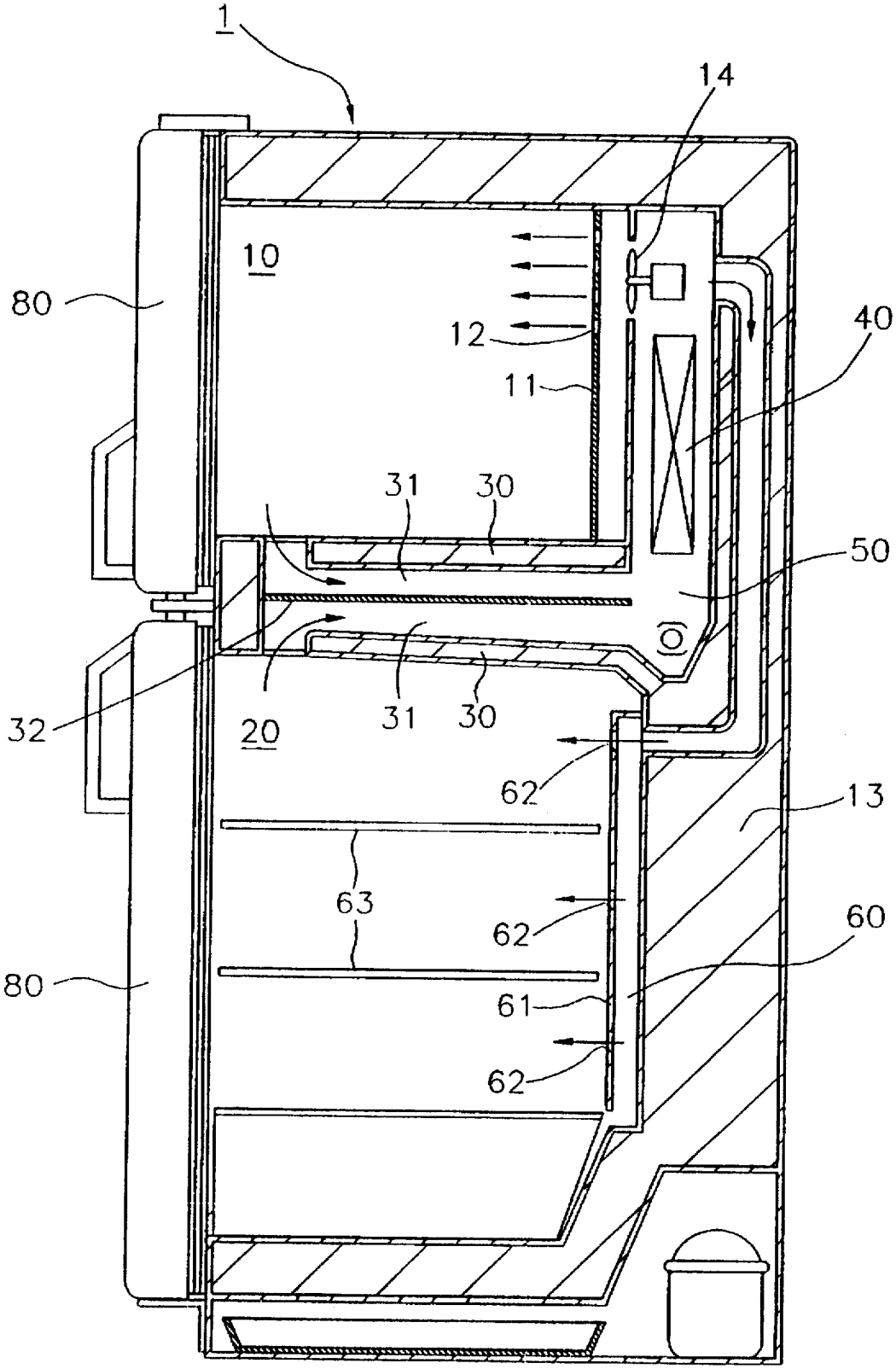
FIG. 1 PRIOR ART
FIG. 1 is a side view in partial section showing the major part of a refrigerator according to a conventional art.
Figure 2:
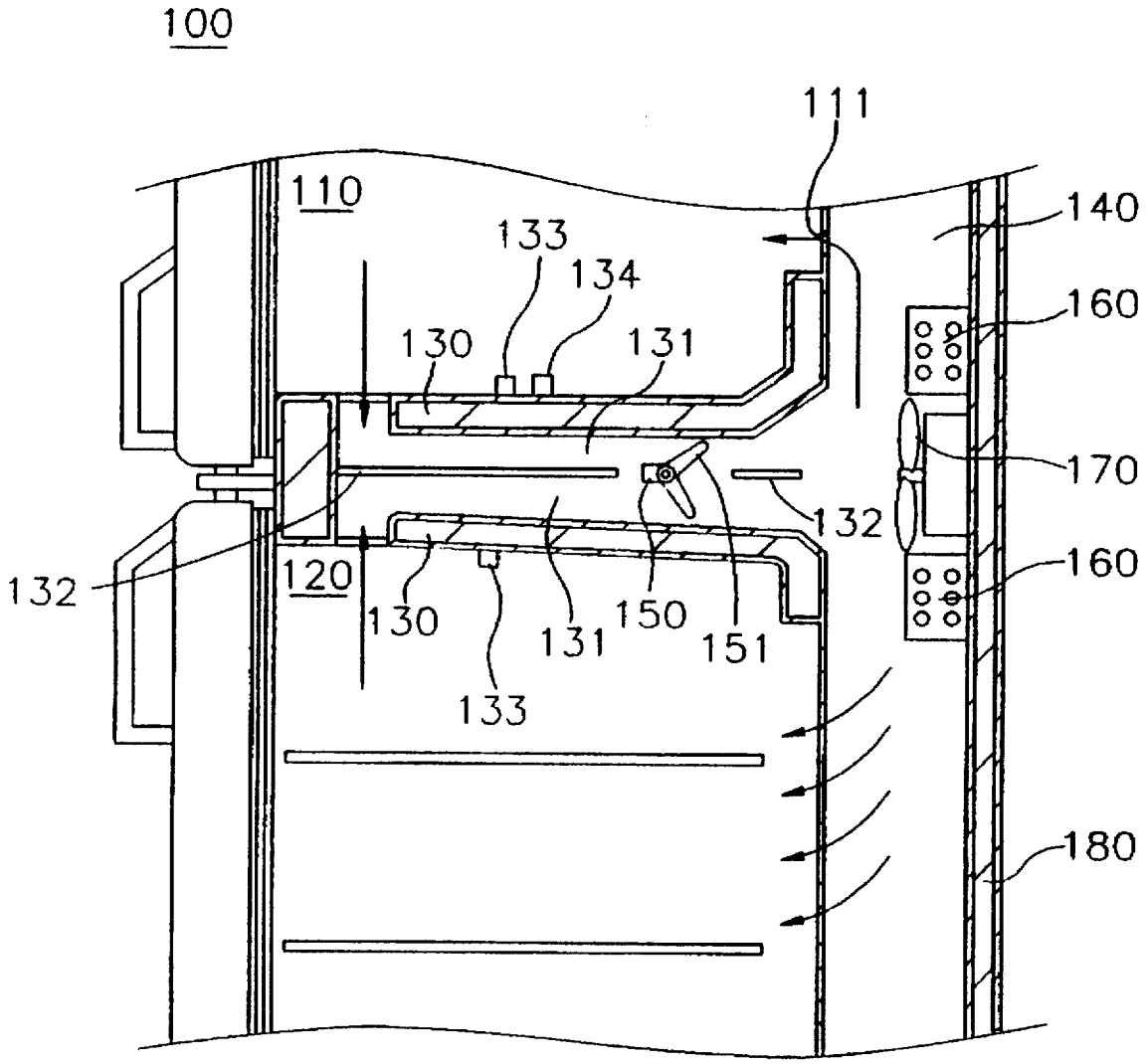
FIG. 2 is a side view in partial section showing the major part of a refrigerator installed with a cool air regulator structure according to the present invention.

FIG. 2 shows a side view in partial section of the major part of the refrigerator installed with the cool air regulator structure according to the present invention.

A separating plate 130 formed between a freezing compartment 110 and a fresh food compartment 120 internally has two plates which constitute a partition 132 by being spaced apart from each other at a prescribed distance. Partition 132 divides a cool air return duct into an upper cool air return duct 131 and a lower cool air return duct 131. A driving part 150 is installed to the space provided between the two plates. Driving part 150 swings an air variable blade 151 into the upward, downward or neutral position. Air variable blade 151 closes upper cool air return duct 131, closes lower cool air return duct 131 or is disposed in the neutral position via the swinging by driving part 150.

By using a solenoid coil as a driving part 150, air variable blade 151 can be fully opened or fully closed.

When a step motor is employed as driving part 150, a swinging angle of air variable blade 151 can be varied in stages.

Once air variable blade 151 swings downward, the supply of the cool air into fresh food compartment 120 is decreased according to the swinging angle of air variable blade 151 while more cool air is supplied into freezing compartment 110 as a result.

Also, a cooling fan 170 is installed to a rear wall 180 at the immediate rear portion of upper and lower cool air return ducts 131 and 131, and a single evaporator 160 is separatively installed to the up and down sides of cooling fan 170. The reason of separating evaporators 160 and 160 is for facilitating the flow of the cool air. After cooling fan 170 takes in the cool air of freezing compartment 110 and fresh food compartment 120 via cool air return ducts 131 and 131, the cool air is further cooled via evaporators 160 and 160 and then is circulated throughout freezing compartment 110 and fresh food compartment 120 via main cool air duct 140 and cool air supply holes 111 and 121.

During this time, driving part 150 for operating air variable blade 151 is operated under the control of temperature sensors 133 and 133 installed to freezing compartment 110 and fresh food compartment 120.

That is, if the temperature within fresh food compartment 120 is higher than a preset temperature while the temperature within freezing temperature 110 maintains a preset highly cold temperature, temperature sensors 133 and 133 sense the temperature status to drive driving part 150. By doing so, air variable blade 151 swings upward for supplying much more cool air into fresh food compartment 120. The temperature setting is manually set by an adjusting part 134 installed within refrigerator 100.

The cool air regulator structure of refrigerator 100 constructed as above is merely one embodiment of the present invention, and it is intended that variations and/or modifications of the present invention, e.g., the construction and shape of the cooling regulator structure, can be accomplished while still maintaining the scope of the invention herein involved.

The above-mentioned refrigerator 100 equipped with the cool air regulator structure according to the present invention constructed as above is operated as below.

In connection with the flow of the cool air within refrigerator 100, the cool air produced from evaporators 160 and 160 passes through main cooling duct 140 to be supplied into freezing compartment 110 and fresh food compartment 120 via cool air supply holes 111 and 121 by cooling fan 170. The cool air after being circulated throughout freezing compartment 110 and fresh food compartment 120 returns to evaporators 160 and 160 via cool air return ducts 131 and 131 provided within separating plates 130.

When the temperature of freezing compartment 110 is higher than the preset temperature and the temperature of cooling chamber 120 reaches the preset temperature, temperature sensors 133 and 133 sense the current temperature status to drive cooling fan 170 and driving part 150.

Once driving part 150 starts to operate, air variable blade 151 interrelated with driving part 150 swings downward to allow almost all cool air to be supplied into freezing compartment 110 in order to lower the temperature within freezing compartment 110.

On the contrary, when the temperature of fresh food compartment 120 is higher than the preset temperature and the temperature of freezing compartment 110 reaches the preset temperature, temperature sensors 133 and 133 sense the temperature within fresh food compartment 120 to drive cooling fan 170 and driving part 150, thereby swinging air variable blade 151 upward. At this time, almost all cool air is supplied to fresh food compartment 120 to quickly cool down fresh food compartment 120 to the preset temperature.

In the refrigerator having the cool air regulator structure according to the present invention constructed as above, the quantity of cool air supplied into the freezing compartment and fresh food compartment can be regulated to maintain the proper temperature of freezing compartment 110 and fresh food compartment 120, thereby preventing degeneration of refrigerated food.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A cool air regulator structure of a refrigerator including cool air return ducts within a separating plate installed between a freezing compartment and a fresh food compartment, comprising:

a partition formed by two plates for dividing the interior of said cool air return duct into two sides of upper and lower portions, said two plates being spaced apart from each other by a prescribed distance;

an air variable blade swinging about a hinged shaft along a center line of said partition within a space provided between said two plates within said cool air return ducts for blocking the upper or lower cool air return duct;

driving means for swinging said air variable blade into an upward, downward or neutral position;

a cooling fan installed to a rear wall on the rearmost side of said partition for circulating said cool air;

evaporators placed to upper and lower portions of said cooling fan;

controlling means for controlling said driving means into the upward, downward or neutral position; and adjusting means for setting said controlling means at a desired temperature.

2. A cool air regulator structure of a refrigerator as claimed in claim 1, wherein said controlling means controls said driving means and cooling fan simultaneously.

3. A cool air regulator structure of a refrigerator as claimed in claim 1, wherein said driving means is comprised of a solenoid coil.

4. A cool air regulator structure of a refrigerator as claimed in claim 1, wherein said driving means is comprised of a step motor.

5. A cool air regulator structure of a refrigerator as claimed in claim 1, wherein said controlling means is comprised of a temperature sensing means.

6. A cool air regulator structure of a refrigerator as claimed in claim 1, wherein said controlling means is installed to said freezing compartment and said fresh food compartment.

* * * * *